US005226724A

United States Patent [19]

Kanarek

[11] Patent Number: 5,226,724

[45] Date of Patent: Jul. 13, 1993

[54] MODULAR, USER-INSTALLED, SURFACE-MOUNTED, FLUORESCENT LIGHTING SYSTEM

[76] Inventor: Shepard S. Kanarek, 78627 Dancing Waters Rd., Bermuda Dunes, Calif. 92201

[21] Appl. No.: 900,144

[22] Filed: Jun. 17, 1992

[51] Int. Cl.[5] ..... F21K 2/00

[52] U.S. Cl. ..... 362/260; 362/151; 362/219; 362/222; 362/226

[58] Field of Search ..... 362/151, 216, 219, 222, 362/225, 226, 260; 439/115, 119, 120, 209, 210, 213, 216, 226, 228, 231, 235

[56] References Cited

U.S. PATENT DOCUMENTS

| | | | |
|---|---|---|---|
| 1,940,368 | 12/1933 | Page | 439/235 |
| 2,708,711 | 5/1955 | McGinty et al. | 362/151 |
| 3,211,904 | 10/1965 | Schwenkler | 362/260 |
| 3,428,799 | 2/1969 | Bassani | 362/219 |
| 3,735,122 | 5/1973 | Ebin et al. | 362/216 |
| 4,639,841 | 1/1987 | Salestrom et al. | 439/209 |
| 5,007,853 | 4/1991 | Olsen | 439/209 |

FOREIGN PATENT DOCUMENTS

| | | | |
|---|---|---|---|
| 0452770 | 11/1948 | Canada | 439/216 |

*Primary Examiner*—Albert J. Makay
*Assistant Examiner*—Alan B. Cariaso

[57] ABSTRACT

A modular, fluorescent, indirect lighting system which may be easily mounted to most surfaces by the user, without any technical knowledge or experience, using just a screwdriver and measuring tape. The system is comprised of a family of plug-in modules, each of which contain an integral power bus (84 and 86), that provides power continuity to the adjacent module, and a gender conversion plug (42) that allows the installer to configure each module so that power is supplied only from female connectors. The system includes a power source module (110) and three sizes of illumination modules (156, 158 and 52), which house single 20, 30 or 40 watt lamps, as well as inside and outside corner modules (118 and 122) and both straight and corner adjustable-length modules (128 and 148). Modules selected from this family can be plugged together to create a cove lighting system for a room of almost any size or shape. The complete installation is powered by a neat line cord (116) plugged into a standard wall outlet. And, each module can accommodate a continuous decorative facing strip (126) that both enhances the appearance and conceals the modular nature of the system.

15 Claims, 8 Drawing Sheets

MODULAR, USER-INSTALLED, SURFACE-MOUNTED, FLUORESCENT LIGHTING SYSTEM

BACKGROUND

1. Field of Invention

This invention relates to fluorescent lighting fixtures, specifically to a modular design that may installed on any surface, in 61, 91 or 122 centimeter (2, 3, or 4 foot) lengths. It may be plugged together and then connected to an electrical wall outlet, safely and easily, to provide an attractive, continuous, source of lighting.

2. Discussion of Prior Art

Heretofore, fluorescent lighting was limited to three types: integral installations built into the building, or separate large lighting fixtures designed to be hung from or mounted to the ceiling, or smaller fixtures to be mounted to a wall or the underside of a kitchen cabinet.

These integral installations include fixtures recessed into the ceiling which provide direct lighting downward through a diffuser. Or, they are built into architectural coves, cornices, valences, soffits or canopies, which are permanently attached to the walls. They provide indirect lighting—reflected from the walls and ceiling. If not originally built into the structure these integral fixtures require a custom design and will usually be quite difficult and expensive to install.

The separate lighting fixtures (both large and small) are designed to either be wired into an electrical junction box or are provided with a cable that must be plugged into an electrical outlet. Either is difficult for the user to install unless an electrical power source is at or near the new fixture location. Many homes and apartments built since 1960 have no ceiling lights or wiring in the ceiling. Instead they have wall switches that control room wall outlets. Table lamps and floor lamps consume valuable floor space and often dictate the arrangement and decoration of a room. However, the difficulty of bringing power unobtrusively to a new location has discouraged many from installing new ceiling or wall lights.

No means was previously available to the user to install an attractive lighting system that could just plug into any existing wall outlet and be extended around the room in virtually any surface-mounted configuration. No means was available for the user to easily and inexpensively simulate the spectacular and sumptuous effect of a room indirectly lit by an architectural cove.

A number of earlier patents have incorporated an internal power bus in a modular unit. These permitted the installation of a plurality of serially attached unit that are powered by the preceding internal bus. However, two of these, U.S. Pat. Nos. 1,249,500 to Richter (1917) and 4,096,379 to Taylor (1978) are not intended for use with fluorescent lamps and make no provision for the necessary starter and ballast equipment.

Some patents, including U.S. Pat. Nos. 4,725,931 to Bourdon (1988), 3,436,537 to Bostonian (1969), and 1,249,500 to Richter (1917) (mentioned above), are quite complicated and require installation by a licensed professional. Or, they require substantial (off-site) adaptation to each installation by a professional. And, they must then be installed by licensed or highly experienced personnel.

U.S. Pat. No. 4,096,379 to Taylor (1978) (mentioned above) could be installed by the average, inexperienced, consumer. But it has no special features to encourage a safe installation and minimize the potential shock hazard to the installer or anyone who maintains, modifies or replaces those units. That design permits the installer to configure a system in which one or more male plugs are powered, presenting a serious shock hazard. U.S. Pat. No. 2,344,935 to Whittaker (1944) does provide for intermodule connectors to be configured as either male or female. But, it requires disassembly of a module housing and the removal and replacement of a number of electrical contact fittings. That may be well beyond the capabilities of many potential users. Further, this patent does not incorporate any circuit breaker device to prevent overloading the capacity of the power line. And, it does not provide indirect illumination or an attractive appearance.

U.S. Pat. No. 3,007,036 to Mills, Jr (1961) describes a housing for cove or cornice installations of fluorescent lighting, that includes provision for a decorative insert of continuous length. But, it does not incorporate a concept of modular "plug-in" fixtures. It only provides a decorative housing combined with fluorescent fixtures attached to a continuous wiring duct. Accordingly, it requires professional (and in many cities, licensed) installation.

OBJECTS AND ADVANTAGES

This invention permits the user to design and install his own wall (or ceiling) mounted lighting system by plugging together 20, 30 or 40 watt fluorescent modules along surfaces and around corners. He need use just a screwdriver and a measuring tape (or a carpenter's level). And, it is powered by only a single attractive connection to an existing electrical wall outlet.

It is provided to the consumer with female power receptacles at both ends and only requires the user to decide which end will be plugged into a powered receptacle (or module). They then install a double-ended-male, gender conversion plug into the receptacle at that end, with the installation of a single screw.

Accordingly, several objects and advantages of my invention are:

(a) To provide a new system of fixtures, corner adapters and a power connector for the conventional 20, 30 and 40 watt fluorescent tubes that make them an attractive and economical lighting option for use in residences, stores, office buildings, schools, libraries, etc.

(b) To provide a lighting systems designed for 'do-it-yourself' or professional installation, which in its preferred embodiment is an attractive wall-mounted cove lighting system. It provides comfortable, diffuse, shadowless, glare-free indirect lighting, reflected from the wall and ceiling.

(c) To provide a lighting system which eliminates the constraints of lamp tables or floor lamps on the arrangement of furniture in the room. And, it provides a very interesting and soothing appearance.

(d) To provide, in the preferred embodiment, a cove-illuminated ceiling that has a floating, almost infinitely deep or sky like quality. The effect is pleasant and it can be used to give the impression of height in a large room with a low ceiling.

(e) To provide a modular lighting system, comprised of modules that are 61, 91 or 122 centimeters (2, 3 or 4 feet long), each holding a single fluorescent tube and the necessary starter/ballast circuitry for that tube. They are contained in a sleek, narrow, attractive housing that projects and reflects the light from the tube in a plane toward the ceiling and along the wall, on which it is mounted.

(f) To provide a modular lighting system comprised of modules, of various lengths that each contain an integral power bus. This bus provides an electrical path through the fixture starting at one female electrical connector at the left end of the module and ending at an identical female electrical connector at the right end of the module. Power is tapped from that bus to illuminate the fluorescent tube within that module.

(g) To provide a modular lighting system with a integral power bus design that permits the user/installer to join together a number of modules. And, power them all with only a single connection to an electrical power outlet, from either end of the string of modules, or from any junction between two of the modules.

(h) To provide a modular lighting system in which the quantity of modules that can be joined together is only limited by the size of the wire utilized in the integral power bus and the capacity of the power outlet to which it is connected. But, it is protected by a circuit breaker which is built into the power source module.

(i) To provide a modular lighting system where the modules are joined together, electrically, with small male-to-male gender conversion plugs. These are attached by the installer to one end of each module to provide both a safe and convenient "plug-in" configuration.

(j) To provide a modular lighting system in which a custom installation is accomplished through the use of inside and outside corner modules and vertical offset modules. These provide electrical continuity, permitting the cove to be fitted to any room configuration.

(k) To provide a modular lighting system that allows the user/installer to assemble, if they wish, a continuous cove lighting system that completely encircles the room. It can conform to inside and outside corners, and can even be stepped up or down, along its horizontal path, to bypass air-conditioning vents or door and window openings.

(l) To provide a modular lighting system in which the corner modules may be either lighted or unlighted. The lighted corner modules will incorporate a small bent-tube fluorescent bulb and ballast to provide full lighting continuity through the corners.

(m) To provide a modular lighting system that will also incorporate both lighted and unlighted adjustable-length units that contain removable power bus wiring. They can be cut by the installer to any length, to permit custom installations that will fill any wall "precisely". These lighted adjustable-length units will (length permitting) house small bent-tube lamps like those used in the illuminated corner modules.

(n) To provide a modular lighting system that permits the installer to join a large number of modules and provide electrical power to all of them through just a single inconspicuous connection to an existing wall outlet, preferably one controlled by the room wall switch.

(o) To provide a modular lighting system in which the power connection can be made from either end of a linear array of modules, or from the junction between any two modules. It uses a power source module that has the same cross-sectional shape as the illumination and corner modules but is only about 5 centimeters (2 inches) wide. It contains the power bus, a tap-off to the power cable, and a circuit breaker to protect the entire string of illumination modules and corner modules connected to it.

(p) To provide a modular lighting system where an optional (push-on, push-off or rocker) switch may also be installed on the power cable to enable connection to an unswitched power outlet.

(q) To provide a modular lighting system that can be easily assembled from a series of light modules, corner modules, adjustable length modules and a power source module. But, it retains the finished appearance of a beautiful "continuous" custom cove lighting system, that perfectly matches (or complements) the walls on which it is mounted.

(r) To provide a modular lighting system which achieves a custom appearance through the use of one or two channels formed into the module housing, one along the front and possibly another along the bottom of the module housing. Each channel can accommodate a strip of paper (sold separately) or other decorative material such as wall-paper, wood grained or metallized vinyl, which provides a continuous front surface (and possibly a continuous bottom surface), hiding the joints between the modules.

(s) To provide a modular lighting system design that also incorporates provisions for the attachment of a variety of very decorative, paintable, extruded, plastic cove moldings. They will snap into the front channels of the module housings and can simulate any architectural or decorating style.

(t) To provide a modular lighting system that will accept plastic cove moldings which could be made available in substantial lengths, of 10 to 20 feet. They may be mitered for the corner joints and installed without a seam in many small to medium size rooms.

(u) To provide a modular lighting system in which molded plastic decorative cove joint covers will be available to fit the contours of the cove moldings and to conceal the vertical seam, when the length of a wall requires that two or more lengths of cove molding be used. These decorative joint covers can be provided in a variety of designs ranging from simple modern joint fairings to elaborate crests or other baroque styles.

(v) To provide a modular lighting system that can be quickly and easily installed by either a professional or the user, without the need for any experience or technical knowledge.

(w) To provide a modular lighting system that is installed by first marking a line on the wall, just above eye-level. Then each module is mounted to the wall along that line using just two screws. The modules are held in axial alignment by the shell of the gender conversion plug, which fits snugly into the recessed power bus receptacle in the end of each module.

(x) To provide a modular lighting system in which a neat power connection can be made by locating the power source module near to and above the wall outlet to which it will be connected. The wire anchor provided is used to hold the cable taut, against the wall, and to route the wire through either a right or left turn toward the wall outlet.

(y) To provide a modular lighting system which may be used in an alternative application that will produce dramatic lighting for pictures or drapes when the lighting modules are mounted to the ceiling, facing the wall to be illuminated. The distance they are mounted from the wall will control the portion of the wall, down from the ceiling, that is illuminated—and the intensity of the illumination.

(z) To provide a modular lighting system that simulates an expensive permanent custom installation but can actually be easily removed and reused elsewhere, with a minimum of repair required to restore the wall to its original condition. This feature is particularly desirable when the system is installed in rented housing.

Still further objects and advantages will become apparent from a consideration of the ensuing description and drawings.

DRAWING FIGURES

Reference Numerals In Drawings

Figure 1:
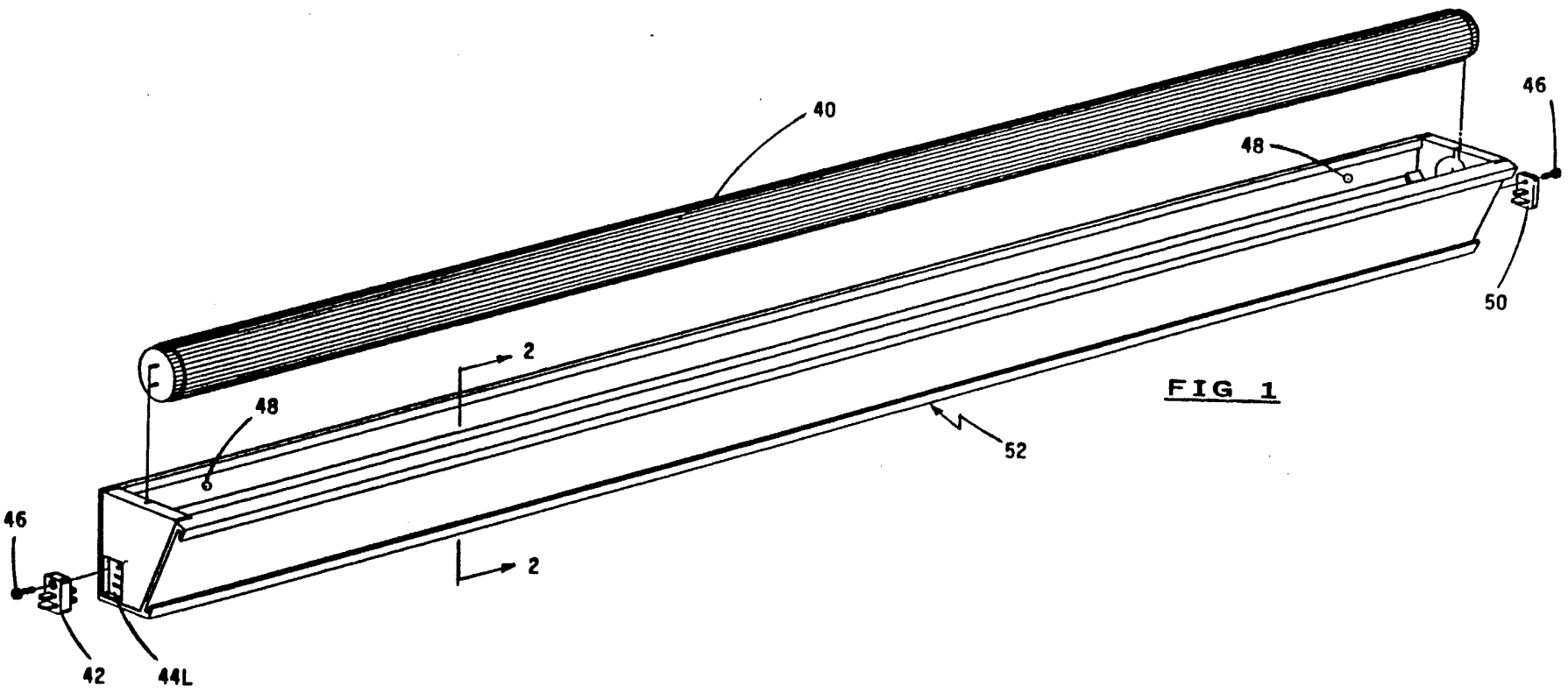
FIG. 1 is a perspective view of the illumination module assembly, the gender conversion plug, receptacle cap and fluorescent tube.

| | | | |
|---|---|---|---|
| 40 | fluorescent tube | 42 | gender conversion plug |
| 44 | power bus receptacles (L, R, T & B) | 46 | screw |
| 48 | mounting hole | 50 | receptacle cap |
| 52 | illumination module | 54 | reflector partition (fourth wall) |
| 56 | rib - rear surface (first wall) | 58 | rib - front surface (third wall) |
| 60 | rib - bottom surface (second wall) | 62 | front channel |
| 64 | module body | 66 | module end assembly (L & R) |
| 68 | fluorescent tube socket | 70 | curved flanges (T & B) |
| 72 | ballast lead contact | 74 | ballast lead contact |
| 76 | power bus contact (L & R) - (illumination module) | 78 | ground bus contact (L & R) - (illumination module) |
| 80 | narrow terminal lug | 82 | wide terminal lug |
| 84 | power bus lead - (illumination module) | 86 | ground bus lead - (illumination module) |
| 88 | capacitor - large | 90 | resistor |
| 92 | choke | 94 | circuit board |
| 96 | triac | 98 | diode |
| 100 | diode | 102 | resistor |
| 104 | resistor | 106 | capacitor |
| 108 | ballast lead contact | 110 | power source module |
| 112 | module ends (L & R) | 114 | circuit breaker |
| 116 | line cord | 118 | inside corner module |
| 120 | inside corner body | 122 | outside corner module |
| 124 | outside corner body | 126 | decorative facing strip |
| 128 | adjustable straight module | 130 | adjustable endplate assembly (L & R) |
| 132 | adjustable flange plate (L & R) | 134 | thin sheet |
| 136 | adjustable end assembly (L & R) | 138 | power bus contact (L & R) - (adjustable module) |
| 140 | ground bus contact (L & R) - (adjustable module) | 142 | adjustable module body |
| 144 | power bus lead - (non-illumination module) | 146 | ground bus lead - (non-illumination module) |
| 148 | adjustable inside corner module | 150 | adjustable module body - (inside corner) |
| 152 | switch | 154 | wire anchor |
| 156 | 20 watt illumination module | 158 | 30 watt illumination module |
| 160 | vertical offset module | 162 | mounting well |
| 164 | assembly hole | 166 | insulation cover |
| 168 | threaded rod | 170 | nut |
| 172 | decorative cove molding | 174 | longitudinal flange (T & B) |
| 176 | mounting plate | 178 | lamp, U-tube - (light kit) |
| 180 | socket, U-tube - (light kit) | 182 | power bus lead - (light kit) |
| 184 | ground bus lead - (light kit) | 186 | starter-ballast enclosure - (light kit) |

-continued

| Reference Numerals In Drawings | | | |
|---|---|---|---|
| 188 | ground bus contact - (light kit) | 190 | power bus contact - (light kit) |
| 192 | notch, for light kit | 194 | ceiling hanger strut |
| | | 196 | metal sleeve |
| | | 198 | razor blade |

DESCRIPTION—FIGS. 1 TO 21

FIGS. 1 through 18 describe the principle elements of this modular, surface-mounted fluorescent lighting system which is comprised of illumination modules, a power source module, inside and outside corner modules, adjustable (straight and corner) modules, vertical offset modules, and a selection of decorative facing strips.

FIG. 1 shows a perspective view of an illumination module assembly 52. A fluorescent tube 40 is shown removed from the module, and a gender conversion plug 42 is positioned just in front of a (left) power bus receptacle 44L, into which it will be installed with a screw 46. A receptacle cap 50 is shown at the extreme right end of this module, where it would be installed into the (right) power bus receptacle, if no additional modules were to be attached. There are two mounting holes 48 in the back surface of this illumination module. While a basic (40 watt) unit is shown in this figure, illumination modules are also envisioned in sizes to accommodate 20 watt and 30 watt fluorescent lamps.

Figure 2:
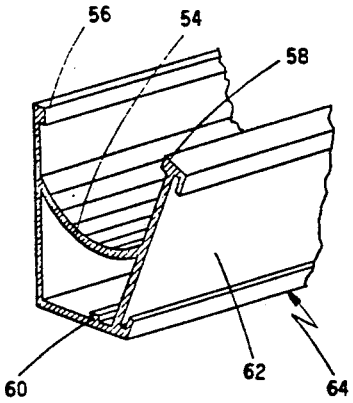
FIG. 2 is a view in detail of a portion of the module body section indicated by the section lines 2—2 in FIG. 1.

FIG. 2 is a view of a portion of the illumination module body indicated by the section lines 2—2 in FIG. 1. In this preferred embodiment, a module body 64 is an extruded elongated trough in which the first wall (rear surface) extends vertically and the second wall (bottom surface) extends horizontally from the bottom edge of the rear surface, and the third wall (front surface) is joined to the bottom surface at an obtuse angle of about 117 degrees. A fourth wall which is a curved reflector partition 54 joins the front and rear surfaces and creates a lower passage where the power bus wiring and the starter and ballast components are contained. Extruded ribs 56 and 58 that run along the top inside edges of the rear and front surfaces and a bottom rib 60, all strengthen the extrusion and (when notched) provide shoulders, against which the module end assemblies rest. Shallow retaining lips along the top and bottom edges of the front surface create a long flat front channel 62, across the front of the module that can accept a decorative facing strip. This embodiment could be extruded from either a white or light colored plastic material or it could be extruded from aluminum and finished with a clear or colored anodize or with a white paint finish. The same features of this module body could also be obtained by fabricating it from a number of metal strips, roll-formed and spot-welded, or riveted together, to achieve a similar cross-section.

Figure 3:
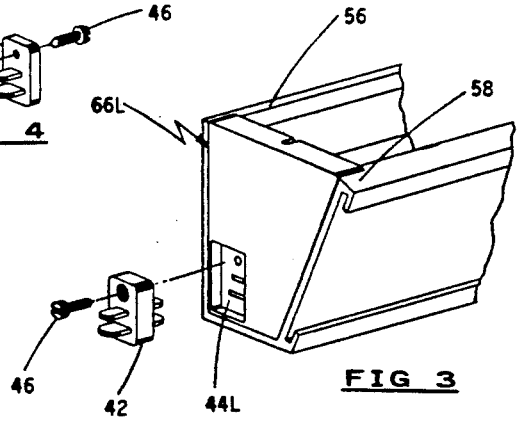
FIG. 3 is an enlarged view of the left end of the illumination module showing the installation of the gender conversion plug into the power bus receptacle with its mounting screw.
Figure 6:
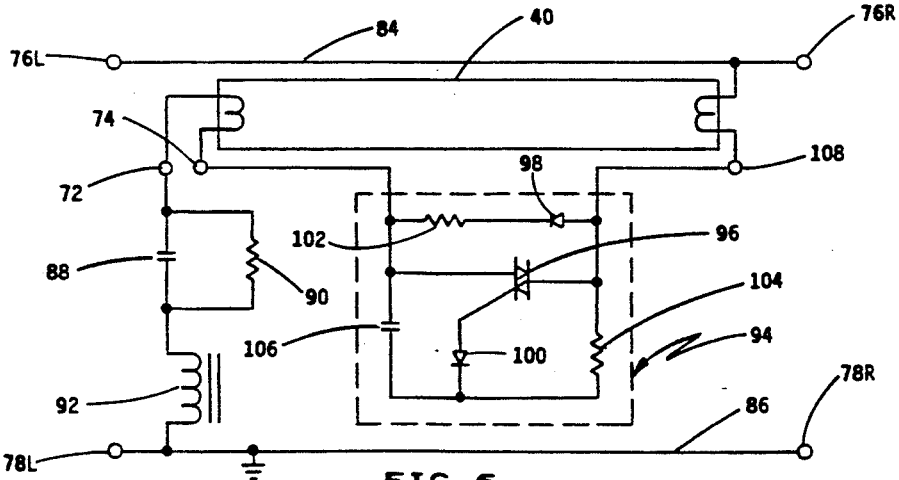
FIG. 6 is a schematic diagram of the electrical connections between the input power, starter and ballast components and the fluorescent tube in an illumination module.

FIG. 3 is an enlarged view of the left end of the illumination module shown in FIG. 1. A left module end assembly 66L rests against the notched ribs 56 and 58, and the details of the left power bus receptacle 44L, can be seen. This shallow rectangular recess contains a pilot hole for the self-threading screw 46, and female contacts for the power and ground blades of the gender conversion plug 42. These contacts, housed within the module left end assembly, (which provide electrical connections between the gender conversion plug, the tube socket, starter/ballast assembly and the power bus, as specified in the electrical schematic, FIG. 6, are made of spring-brass strip and are similar to those found in standard commercial receptacles attached to electrical extension cords. An alternative design of these female contacts could incorporate a friction grip similar to that used in crimp-type disconnect terminals like those made by AMP (Part No. R250). The gender conversion plug 42, is shown as an insulating body (a molded block of insulating material), with two conductive blades embedded in it. Those blades, which protrude from both ends of the plug body form a polarized "male-to-male" gender conversion plug. The upper (narrow) blade is the power connection and the lower (wider) blade is the ground connection. The length and width of the shell of this plug are sized to fit snugly into the recessed well of the power bus receptacle. And, the thickness of the plug is such that when it is mounted into the recessed well (with the screw inserted flush into the counter-bored hole) the portion of the plug that protrudes from this recess will fit snugly into the identical recess on the module into which it is plugged. Thus the gender conversion plug serves to conduct power between two adjacent modules and also to provide physical alignment of the modules.

Figure 4:
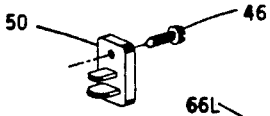
FIG. 4 is a view of the insulating receptacle cap and its mounting screw.

FIG. 4 is an enlarged view of a receptacle cap 50 and screw 46, shown at the right end of FIG. 1. This receptacle cap is made solely of insulating material and does not carry any power, but serves as a safety cover for a powered, but unused, female power bus receptacle. The thickness of this cap is such that it will fit completely within the recess of the power bus receptacle and be flush with the outer surface. It is counter-bored (on the unseen side) to permit a flush installation of the screw head.

Figure 5:
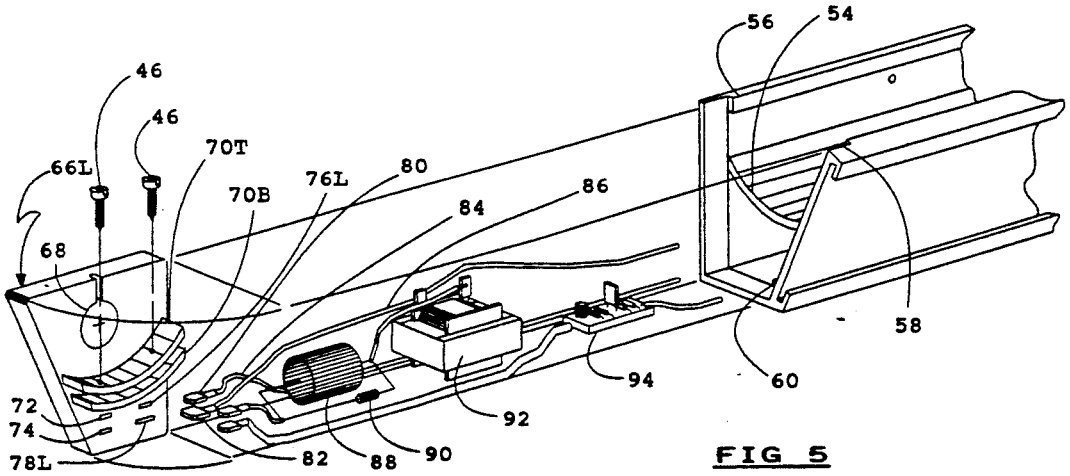
FIG. 5 is an exploded perspective view of the illumination module with the left end assembly removed and the starter and ballast elements removed from the module body.

FIG. 5 is an exploded perspective view of a portion of the illumination module with the left end assembly removed and the power bus leads, starter and ballast components shown removed from the lower passage of the module body. A left module end assembly 66L is shown removed from the extrusion and rotated to the left to show a fluorescent tube socket 68, and a pair of curved flanges (top and bottom) 70T and 70B, which grip the reflector partition, when the screws 46 are installed to mount the module end assembly 66L, within the extrusion. The way in which the ribs 56, 58 and 60 and the reflector partition 54 are notched back to receive the left end assembly is also shown. This left end assembly is a hollow housing containing electrical conductors that connect the tube socket contacts to the inner female power and ground bus contacts 76L and 78L and the outer female contacts in the power bus receptacle, and the female ballast contact 72 and contact 74. A narrow terminal lug 80 is crimped to a power bus lead 84 and a wide terminal lug 82 is crimped to a ground bus lead 86. Additional narrow terminal lugs are used on the starter/ballast leads. FIG. 6 provides connection details.

FIG. 6 is a schematic diagram of the illumination module that identifies the electrical connections between the fluorescent tube 40, the typical starter/ballast components, and the input power, supplied from the power bus receptacle. The power bus lead 84 and the ground bus lead 86 provide power bus continuity between the contacts 76L and 78L on the left module end assembly 66L and contacts 76R and 78R in the right module end assembly 66R (not shown). The starter and ballast circuit shown is a solid-state assembly, produced by Lights of America in Walnut, Calif. and is available as Model No. SS-140120P. It is similar to the electronic capacitive ballast described in U.S. Pat. No. 5,049,789 to Kumar & Ravikrishnan. It is comprised of a large capacitor 88, a resistor 90, a large choke 92, and a circuit board 94, containing a triac 96, two diodes 98 and 100, two resistors 102 and 104, and a capacitor 106. This, representative, solid-state starter and ballast circuit is connected to the right module end assembly (not shown) at ballast lead contact 108, on the schematic. A similar, fully electronic starter/ballast assembly, that can also be used, and is smaller, lighter and much more efficient, is also produced by Lights of America under Model No. EB-140120P. Similar solid-state ballasts are produced by a number of U.S. manufacturers.

Figure 7:
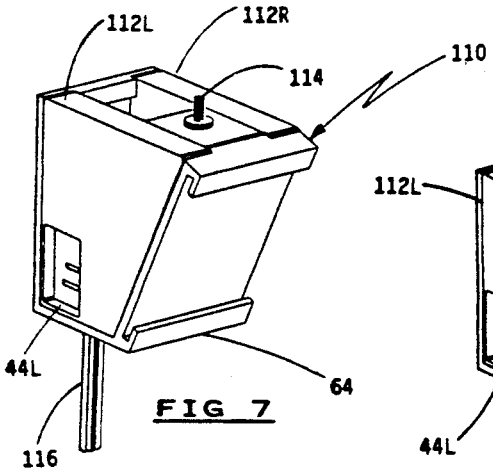
FIG. 7 is a perspective view of the power source module showing a short length of the power cord.

FIG. 7 is a perspective view of a power source module 110 which is constructed from a short length of the same module body 64 extrusion used for the illumination module and it contains the same front channel and internal ribs. Left and right module ends 112L and 112R are similar to the module end assemblies 66L and 66R used in the illumination module but do not contain a slot or socket assembly for a fluorescent tube or the internal ballast lead contacts. Each of these module ends contain the recessed power bus receptacle 44L (and 44R, not shown) that will accept the blades of the gender conversion plugs, that have been installed on the modules, which will be plugged into this power source module, but they do not contain a pilot hole for a mounting screw, above the slots, because a gender conversion plug should not be permanently attached to either side of this power source module, and none are provided with it. A line cord 116, exits from the bottom rear of the module and has a grounded male power plug attached at the other end (not shown). A circuit breaker 114, is installed in a compartment built into the front of this module and the well behind this compartment provides access to the single mounting hole (not shown), in the rear surface of the module.

Many variations are possible for each module. In its simplest embodiment (for a single-sided economy installation) the power source module could consist of a line cord with a male power plug at one end and the molded power bus receptacle 44, for the gender conversion plug, at the other end.

Figure 8:
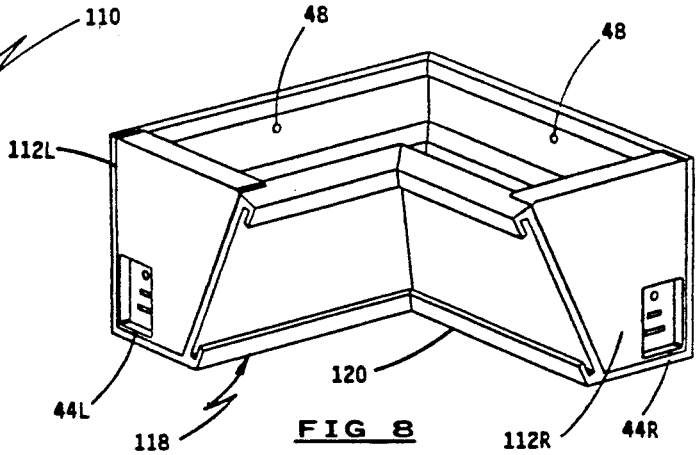
FIG. 8 is a perspective view of an inside corner module that is not illuminated.

FIG. 8 is a perspective view of an inside corner module 118. An inside corner body 120 is comprised of two short (about 15 centimeter or 6 inch) lengths of the same module body extrusion used in the illumination module, which have been mitered and joined to form a right angle. This module also contains both left and right module ends 112L and 112R, identical to those used in the power source module. They contain recessed power bus receptacles 44L and 44R, which provide power continuity through this module. A pair of holes 48, in the rear surfaces of this module are used to mount it to the wall.

Figure 9:
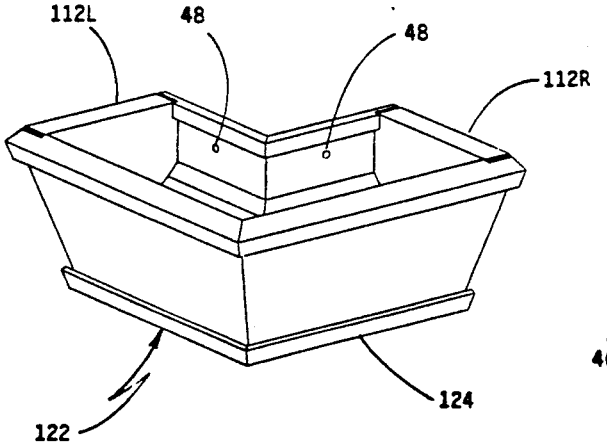
FIG. 9 is a perspective view of an outside corner module that is not illuminated.

FIG. 9 is a perspective view of an outside corner module 122. An outside corner body 124, is comprised of two short lengths of the module body extrusion, mitered and joined to form an outside corner. The left and right module ends 112L and 112R, used here, are identical to those used in the power source module, and they provide power continuity through this module. Again, the hole 48, in each rear surface is used to mount the module to the wall.

Figure 10:
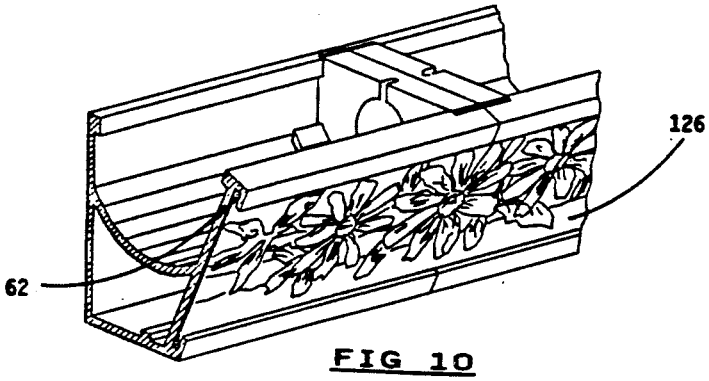
FIG. 10 is a perspective view of the junction between two illumination modules, that illustrates how the decorative facing strip conceals the joint.
Figure 13:
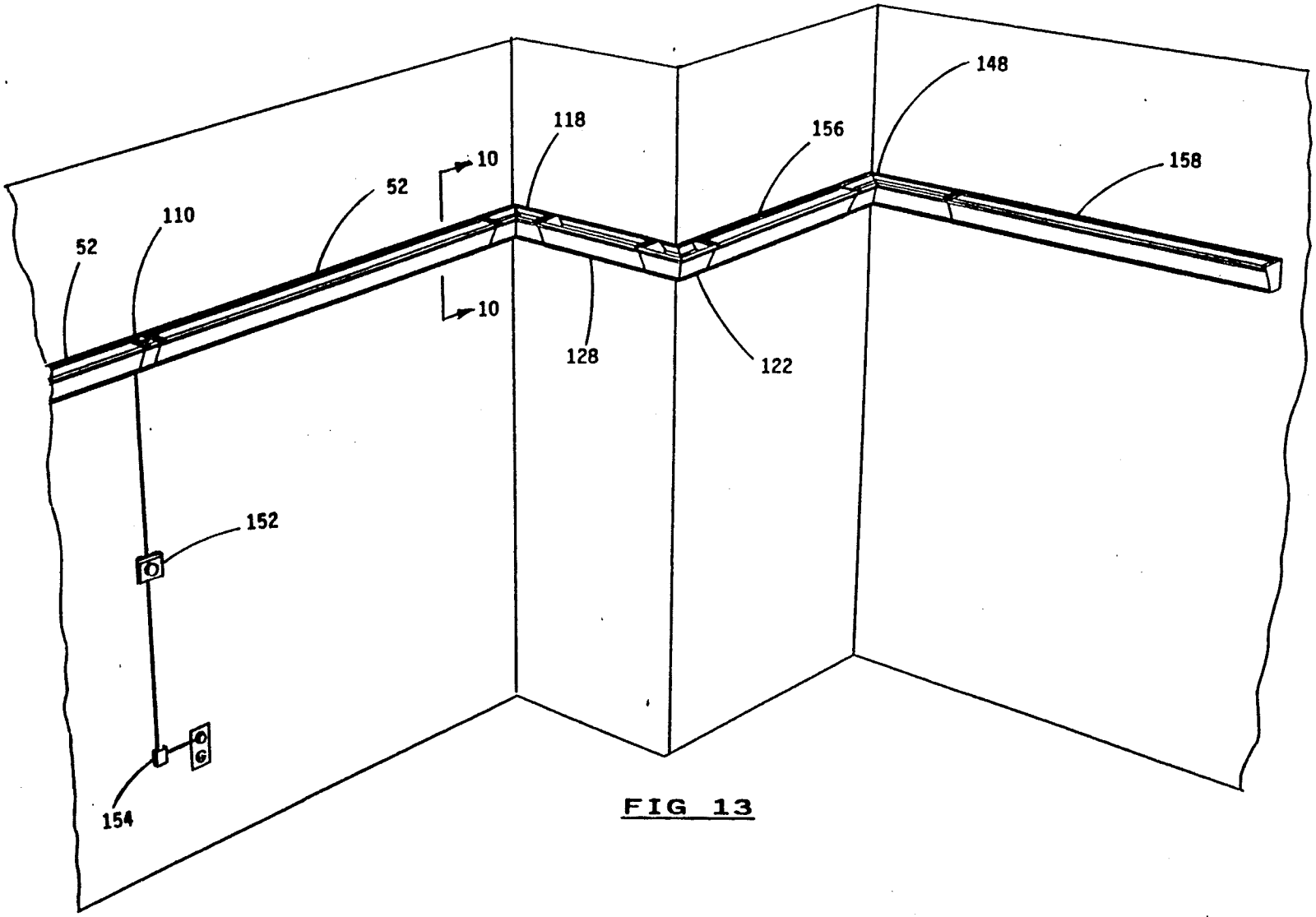
FIG. 13 is a perspective view of a system installation in a room, consisting of one example of each of the system modules.

FIG. 10 is a perspective view of two short portions of adjacent, mated, modules indicated by the section 10—10 in FIG. 13, and it illustrates how a decorative facing strip 126, mounted in the front channel 62, is used to span and conceal the joints between these modules.

Figure 11:
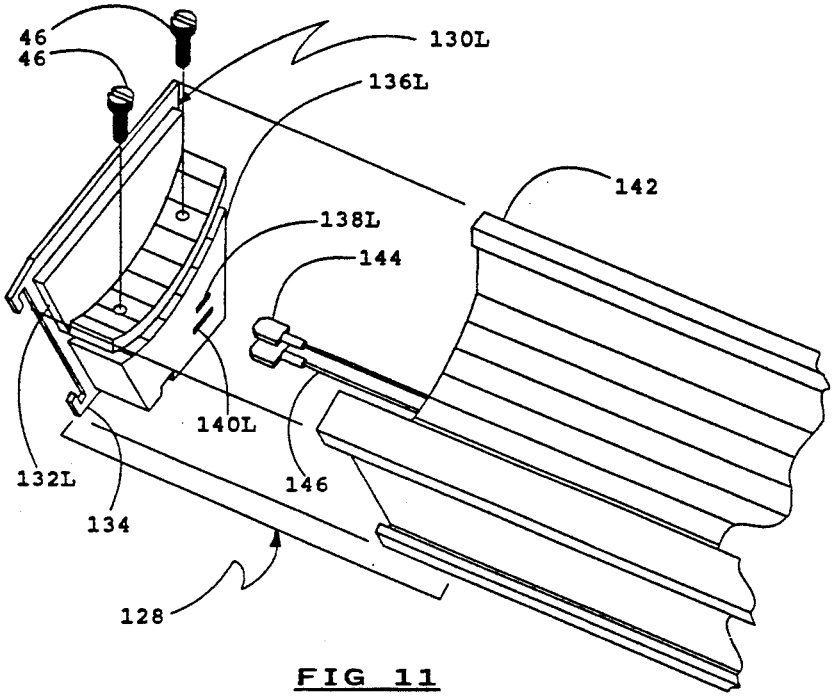
FIG. 11 is an exploded perspective view from above the left end of an adjustable straight module, showing the features of the left end plate assembly and the power bus leads.

FIG. 11 is an exploded perspective view, from above, of the left end of an adjustable straight module 128. A special (left) adjustable endplate assembly 130L, shown here, is used only with adjustable modules. This endplate assembly is constructed from a thin sheet 134, of either metal or strong plastic, which has been cut to exactly match the outline of the module body extrusion and has a cutout for access to the power bus receptacle. An adjustable end assembly 136L is attached to this sheet. It contains an exterior power bus receptacle (not shown—but accessible through the cutout in the thin sheet) that is connected to the interior female power bus contact 138L, and ground bus contact 140L, which are shown. This adjustable end assembly has a large groove in its bottom surface to provide clearance for the rib (not shown) that runs along the inside of the bottom surface of the module body. An adjustable flange plate 132L is also attached to the sheet. The adjustable module body 142 is identical to the illumination module body extrusion except its ribs and reflector partition are not notched to receive the standard module end assemblies. The two screws 46, are used to attach the adjustable endplate assembly 130L to the module body. A power bus lead 144 and a ground bus lead 146 are shown aligned with their respective female contacts on the endplate assembly. In non-illuminated modules these power and ground bus leads are simply heavy gauge conductors that connect the corresponding contacts of the left power bus receptacle to those in the right power bus receptacle, providing a power jumper through the module.

Figure 12:
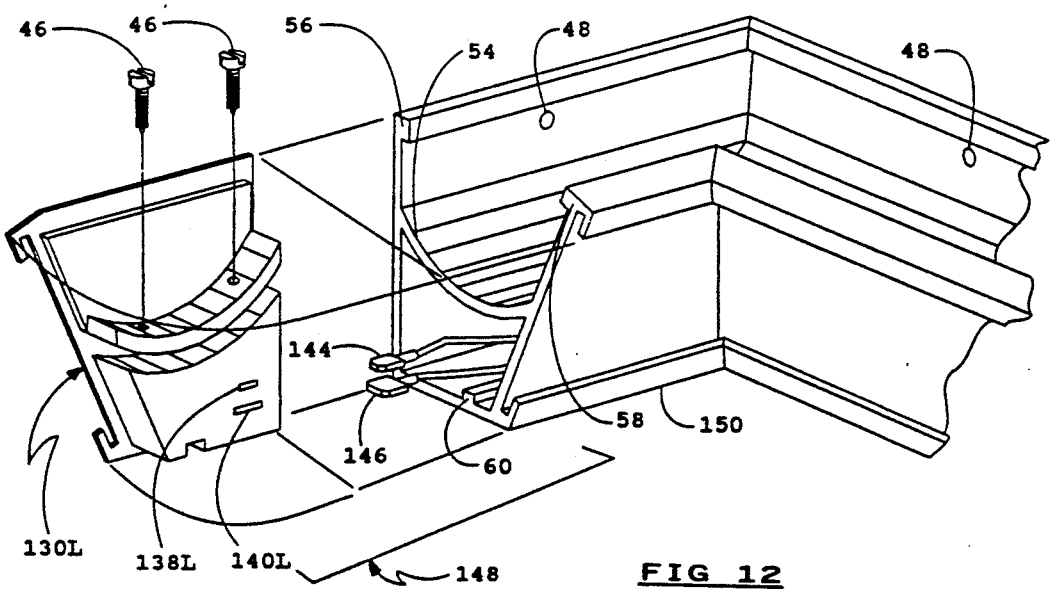
FIG. 12 is an exploded perspective view of an adjustable corner module, showing the left end plate assembly and the power bus leads.

FIG. 12 is a perspective view of an adjustable inside corner module 148 with the left adjustable endplate assembly 130L removed and rotated to the left. The power bus lead 144 and the ground bus lead 146 are shown aligned with their respective female contacts, 138L and 140L, on the left endplate assembly. The adjustable module body 150 is manufactured from the basic module body 64 extrusion, which has been mitered and joined to form the inside corner angle. It has a number of mounting holes 48, in each rear surface. Because it is used with the special adjustable endplate assemblies, it is not necessary to notch the reflector partition 54 or the ribs 56, 58 and 60.

FIG. 13 is a perspective view of a room installation containing each of the modules described above, connected to a power outlet. A switch 152 is shown installed on the line cord and a wire anchor 154 is used to hold the cord taut against the wall and to route the wire neatly through a turn toward the power outlet. This line cord is part of the power source module 110. The basic 40 watt illumination modules 52, are shown plugged into both sides of the power source module. The inside corner module 118 is attached at the right. The space between it and the outside corner module 122, is accommodated by the adjustable straight module 128. A 20 watt illumination module 156, is plugged into the outside corner module. The adjustable inside corner module 148, is cut to accommodate the corner space between the 20 watt illumination module and a 30 watt illumination module 158, on the adjacent wall. This complete sample lighting system is controlled by the switch 152 which incorporates a push-on, push-off or rocker design.

Figure 14:
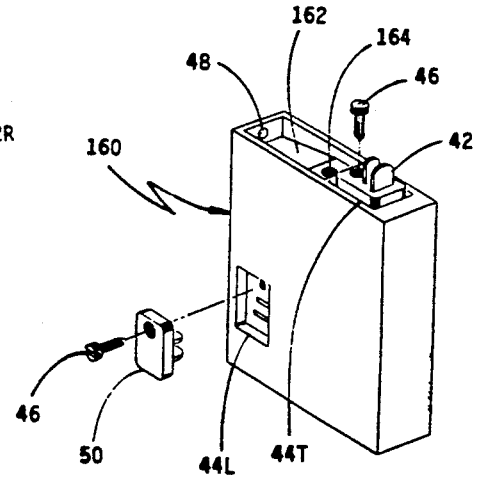
FIG. 14 is a perspective view of a vertical offset module showing the gender conversion plug and the receptacle cap.

FIG. 14 is a perspective view of a vertical offset module 160. This module consists of a narrow vertical housing that is about 5 centimeters (2 inches) taller that a typical module body. It contains four identical power bus receptacles, (left, right, top and bottom—L, R, T & B) one as shown on the left side, 44L, and another directly opposite on the right side (not shown). Another power bus receptacle 44T, is located at the top front of this module, shown with a gender conversion plug 42 installed and a mounting screw 46. The fourth power bus receptacle is located on the bottom surface (not shown), directly opposite the one above. The female contacts within these four power bus receptacles are electrically joined in parallel to provide power distribution. All the power contacts are joined in one circuit, and all the ground contacts are joined in the second circuit. There is a mounting well 162 in the top surface and an identical one opposite, in the bottom surface. Each mounting well contains the mounting hole 48 and an assembly hole 164, that passes vertically through the module and allows multiple modules to be joined together. In this figure, a receptacle cap 50 and screw 46 are shown about to be installed in the left power bus receptacle.

Figure 15:
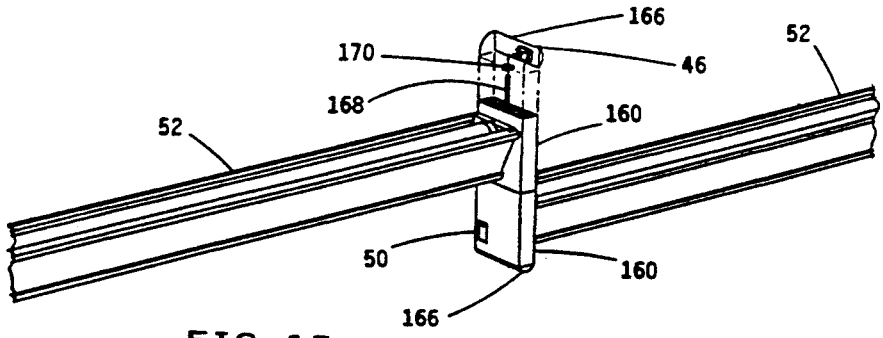
FIG. 15 is a perspective view of two illumination modules joined to an assembly of two vertical offset modules.

FIG. 15 is a perspective view of two illumination modules 52, joined together, with a vertical offset of about 13 centimeters (5 inches), by using two vertical offset nodules 160, a threaded rod 168, with a nut 170, at each end, and an insulating cover 166, installed at the top and bottom of the assembly of vertical offset modules, using screws 46. The upper and lower vertical offset modules are joined electrically by a gender conversion plug (not seen) mounted in the power bus receptacles of their mating surfaces. The receptacle cap 50 is installed on the left side of the lower, and right side (not shown) of the upper vertical offset modules to cover the unused power bus receptacles. The insulating cover 166, is similar to the receptacle cap in construction and is molded completely from insulating materials. It fits into the unused power bus receptacle at the top and bottom surfaces of this assembly, and is retained by screws 46.

Figure 16:
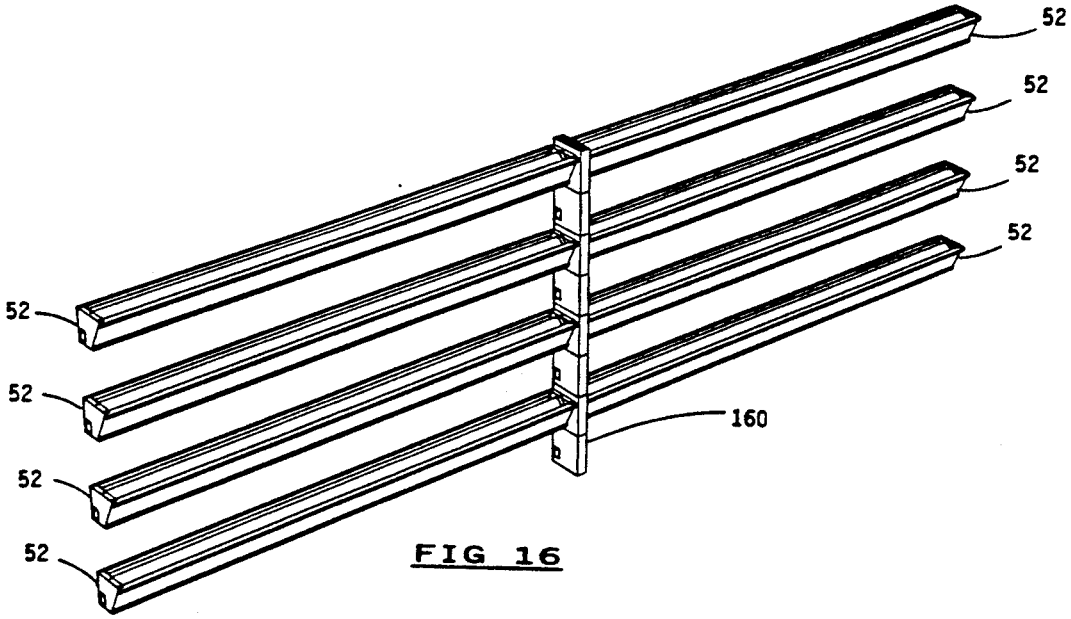
FIG. 16 is a perspective view of eight illumination modules joined to an assembly of vertical offset modules to provide a decorative and highly illuminated wall area.

FIG. 16 is a perspective view of eight illumination modules 52, joined together using eight vertical offset modules 160, to create an unusual wall of light in the configuration of a candellebra. Illumination modules and vertical offset modules can be combined in a great variety of combinations to provide special lighting patterns and configurations.

Figure 17:
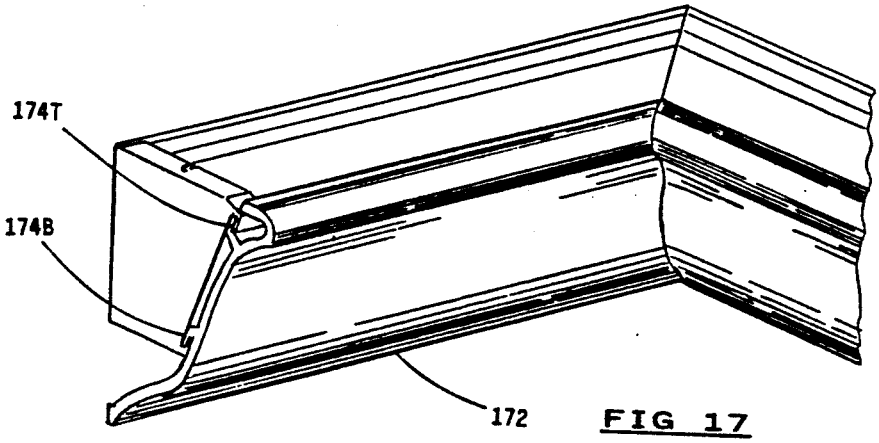
FIG. 17 is a perspective view of the installation of the decorative extruded cove molding to a small corner portion of a lighting system.

FIG. 17 is a perspective view of an inside corner module with a decorative cove molding 172 mitered and installed in the front channel of the module. This extruded cove molding may be provided in a variety of shapes to simulate architectural coves of many styles, and may be provided in lengths to span the entire wall in many rooms. Thus, an installation finished with this molding would be exactly like a very expensive, custom, cove lighting installation. The extrusion would be made of a flexible plastic material, which can be easily deformed to snap its longitudinal flanges, 174T and 174B into the retaining lips of the front channel. The exterior surface may be painted to match the walls, if desired.

Figure 18:
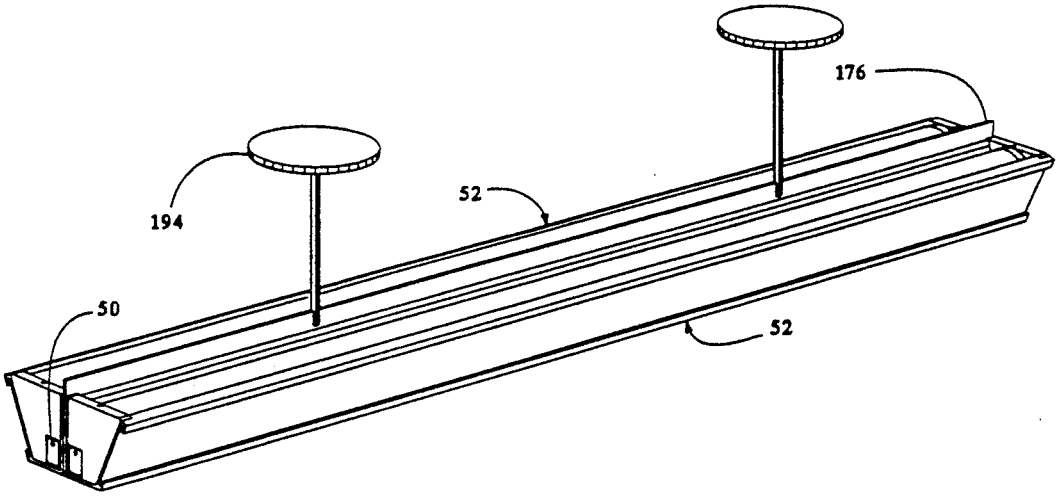
FIG. 18 is a perspective view of two illumination modules assembled back-to-back to produce a unit that can be suspended from the ceiling for indirect lighting.

FIG. 18 is a perspective view of two illumination modules 52, joined together with a mounting plate 176, to create a ceiling mounted fixture. The illumination modules are joined back-to-back using their regular mounting holes with bolts through the mounting plate. Each mounting plate has two ceiling hanger struts 194 attached.

In the basic embodiments, described above, only the illumination modules 52, 156 and 158 provide illumination, (40, 20 and 30 watts respectively). The power source module 110, is very narrow (6 to 8 centimeters) and is non-illuminated. The basic inside corner module 118, and outside corner module 122, are designed to be very short (about 15 centimeters long) and to be non-illuminated. The basic function of these modules is to provide power bus continuity to the illuminated sections. In many installations, non-illuminated corners (particularly these short ones) would be completely acceptable. The basic embodiments of the adjustable straight module 128 and the adjustable inside corner module 148 are non-illuminated. Their basic function is to permit the user to complete an installation that fits perfectly within the corners of a room, of any dimensions and to provide power bus continuity to the illuminated sections.

Figure 19A:
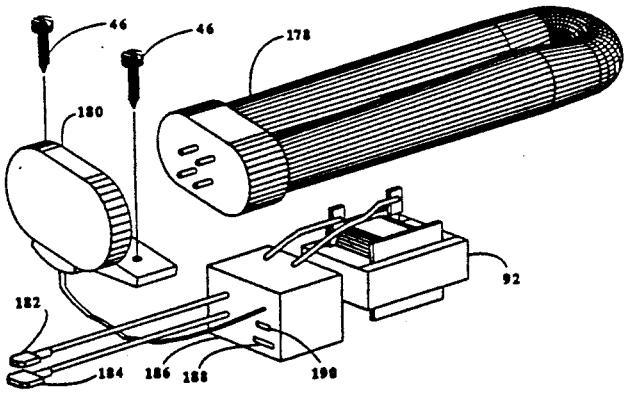
FIG. 19A is a perspective view of an optional light kit for all corner and adjustable modules.

FIG. 19A is an exploded perspective view of an optional light kit, comprising a U-tube fluorescent lamp 178, a socket 180, a choke 92, an enclosure 186, which contains the other starter-ballast components, female receptacles 190 and 188, respectively, for the power bus and ground bus contacts of the corner and adjustable modules, and a power bus lead 182 and ground bus lead 184 for attachment to the module ends 112L of corner modules, or to the adjustable end assembly 136L of adjustable modules. This light kit could use the same components contained in the Model No. 6000-1, U-Tube Fluorescent Bulb and Adapter, produced by Lights of America (LOA), Walnut, Calif. The lamp is a conventional U-tube, of the type produced by LOA under part number FUL 12WW. The bulb socket 180, has been redesigned with a curved bracket, to mount on the existing reflector partition using two screws 46, and the starter/ballast components 186 and 92, are repackaged to fit in the passage under the reflector partition 54, and tap into the existing power bus wiring. The lamp socket is permanently wired to the starter-ballast assembly to minimize the operations to be performed by the installer. These U-Tube lamps, which are also known as Twin Tube Lamps, are also available in 5, 7, 9, and 13 watt sizes from other suppliers such as Sylvania GTE.

Figure 19B:
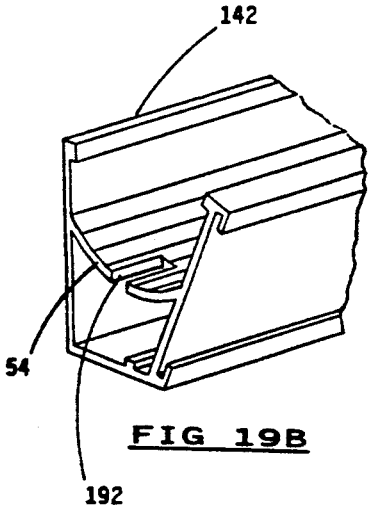
FIG. 19B is a perspective view of a module shell notched to accept the optional light kit.

FIG. 19B is a perspective view of the end of an adjustable module that has been prepared for the installation of the light kit by the installer. A notch 192, has been made in the edge of the reflector partition 54, to permit the wire, joining the socket to the starter-ballast assembly, to enter the lower passage of the module shell.

Figure 20:
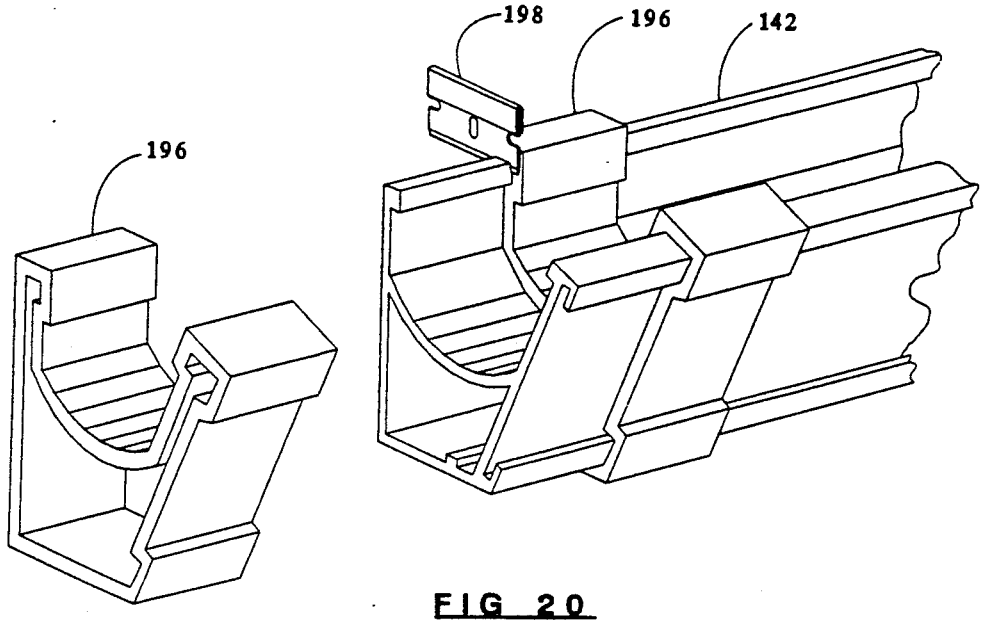
FIG. 20 is a perspective view of the metal sleeve and razor blade being used to trim the length of an adjustable length module, with the sleeve shown both off and on the module shell.
Figure 21:
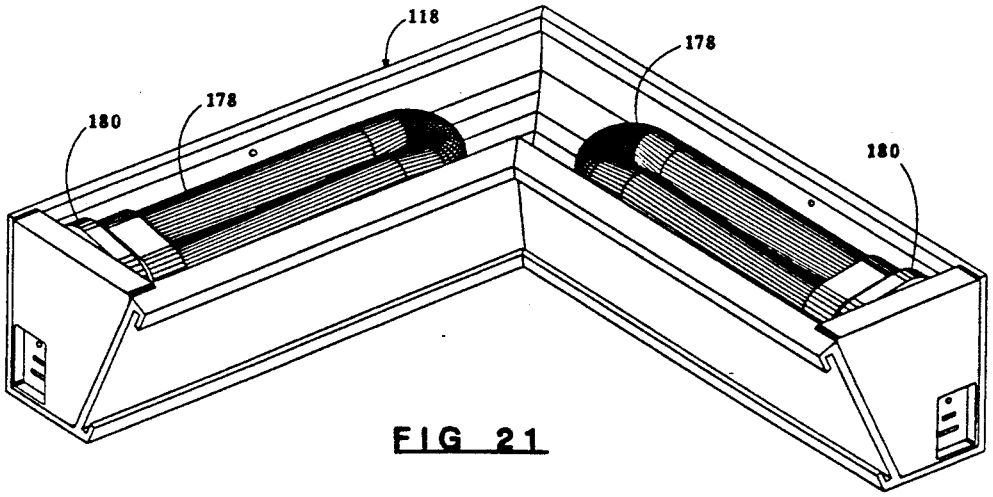
FIG. 21 is a perspective view of an inside corner module with two optional light kits installed.

FIG. 20 is a perspective view of the left end of an adjustable module body 141, being trimmed to the exact length desired using the metal sleeve 196, and the razor blade 198, supplied with the adjustable module. The metal sleeve is shown separately at the left and then shown slid into place to guide the cutting operation. This sleeve can be used to cut either side of the straight or inside corner configurations of the adjustable module. If the module shell were to be extruded of aluminum instead of plastic, a small hacksaw, blade with an integral, handle would have to be substituted for the razor blade. FIG. 21 is a perspective view of an inside corner module 118, fitted with two optional lighting kits installed, which include the sockets 180, the U-tube lamps 178. The wiring, starter-ballast enclosures and the chokes included in these kits are not visible in this figure, but may be seen in FIG. 19A. The shell of this illuminated inside corner is a little longer than the unlit corner module.

OPERATION—FIGS. 1, 2, 7 & 13

This modular, surface-mounted fluorescent lighting system is an inexpensive way for the homeowner or apartment dweller to quickly and easily install indirect fluorescent lighting. The illumination modules are installed on the wall with just two screws for each 1.22 meter (4 foot) section, which provides 40 watts of soft, indirect lighting, that is reflected from the upper wall and ceiling. There are two other illumination modules, a 20 watt unit that is about 61 centimeters (2 feet) long, and a 30 watt unit which is about 91 centimeters (3 feet) long. Each of these modules contain a power bus that transmits electrical power from one end to the other and distributes it to the solid state starter and ballast circuit, and the fluorescent tube, contained in that module. FIG. 1 shows a 40 watt illumination module, with the tube 40, displaced upward so that the two mounting holes 48 can be seen.

Numerous illumination modules can be joined together electrically with the gender conversion plug 42, that is supplied with each module. Each module, illumination or otherwise, is manufactured with female contacts at each end in the power bus receptacles 44L and 44R (right side receptacle not shown). The user can then use the male-to-male, gender conversion plug 42, shown in FIG. 3, to configure the module to have a male power bus connector at either the left end or the right end. This feature is critically important from a safety standpoint. To minimize the hazard of accidental electrical shock, it is essential that power never be made available from a male connector. Thus, if the module to the left were supplying power, its power bus receptacle should be female (as manufactured). The left end of the module that will plug into it, should have the gender conversion plug 42, installed in the left power bus receptacle 44L, just as shown in FIG. 1. Thus, the powered bus connector is always female. After this newly configured illumination module is plugged into the left the only power bus receptacle, that can be accessed on this module, is on the right and has female contacts. Users will be cautioned not to apply power until after the installation is complete. But, this design helps prevent a shock hazard if they ignore that caution either during installation or maintenance.

The quantity of illumination modules that can be joined together in this modular system is limited only by the electrical capacity of the power bus wiring within each unit, the power capacity of the electrical outlet, to which the system is connected, and is controlled by the size of the circuit breaker, built into the power source module 110, illustrated in FIG. 7. If the system wiring were designed for a 10 amp circuit breaker, the system could be configured to provide up to 1200 watts of fluorescent lighting from illumination modules plugged together over a length of more than 36 meters (120 feet).

This lighting system is designed to be installed just above eye-level or just above the top of door frames and window frames. It need only be connected to one electrical outlet to power the entire length, and that one connection is made through the power source module 110 which is very narrow and can be installed at either end of the modular system or between any pair of modules.

The power source module is supplied with a wire anchor 154, and push-on, push-off, or rocker switch 152, which can be seen in FIG. 13. The wire anchor is simply a decorative, molded plastic part that crimps the line cord through a 90 degree turn, and can be installed by the user anywhere along the wire, to hold the wire neat and taut, against the wall. It is mounted to the wall either with two screws or adhesive pads that are supplied. The switch supplied, may be installed by the user anywhere along the line cord, to provide on-off control for the entire modular installation. It is also mounted to the wall either with screws or adhesive pads, supplied. A push-on, push-off, or rocker action is not essential, but is desirable to limit the up-down or side-to-side forces on the simple wall mounting.

If the line cord 116 of the power source module 110 is plugged into a wall outlet that is switched by one or more wall switches, the optional line cord switch need not be installed. Another alternative is to switch the illumination system on and off by remote control, using a device like the On-Off Appliance Module supplied by Radio Shack/Tandy Corp., Fort Worth, Tex., under part number 61-12681 in catalog #472, and the corresponding controller.

INSTALLATION—FIGS. 1, 3, 4, 7–13, 17, 19A, 19B, 20 and 21

Unlike other modular fluorescent systems, installation of this system can be accomplished by a inexperienced user, equipped with only a screw driver, a tape measure (or level) and a pencil. If the system must utilize adjustable length modules 128 or 148 to achieve an exact fit between the corners of a room, the user will find a metal sleeve 196 and a single-edge razor blade 198 included with the module, that can be used to cut the extrusion neatly to the exact length desired.

The installer should start by choosing the power outlet that will be used. They should then plan the size and direction of the installation, starting from that point. Will the modules stretch just along one wall or will they turn a corner and continue, along the adjacent wall for some distance, or perhaps around the entire room. They can plan on 10 watts of fluorescent indirect light for every 30 centimeters (1 foot) of length of an illumination module. Thus, an installation along most of a 6 meter (20 foot) wall will provide 200 watts of light, which may be adequate for many home lighting applications.

If the installation will include at least one corner, the installer should start there and plan the type and number of modules that will be needed, and where the power source module 110, shown in FIG. 7, can be located, so that it is nearest the selected power outlet. While the 40 watt illumination modules 52, shown in FIG. 1, are the most economical (the lamps are the most common and least expensive), 20 or 30 watt modules can be selected to fill a space not large enough for the 40 watt unit. Should the wall length be such that standard modules will not fill it from corner to corner, the installer may use either an adjustable length corner module 148, shown in FIG. 12, at one end or an adjustable straight module 128, shown in FIG. 11, anywhere along the length. The installer must consider that these adjustable length modules will be non-illuminated, unless the optional lamp kit is also used.

Once the modules have been selected and the location of the power source module chosen, the next step is to make a mark on the wall above the power outlet, at a convenient dimension slightly above eye level (2 meters for example). The next task is to extend this mark in a straight line along the wall for the length of the installation. For an attractive installation, the line should be perfectly level. This can be done by using a tape measure to mark the exact same distance, up from the floor (or down from the ceiling) at every meter along the wall, or by making a mark at each room corner and using a chalk line to snap a level guide line between the two points.

Now the modules selected should be unpacked and positioned on the floor just below where they will be installed. The installer should next install the gender conversion plug 42 into each module as shown in FIG. 3 using the screw 46 supplied, to make the proper end a male connection. On every module, the end that points toward the power source module should have the gender conversion plug 42 installed in it.

If no corners are included, the installer should add up the length of the modules selected and measure out that length along the guide line on the wall, deciding how much of the remaining space should be allotted to each side. Then, working from the end closet to the power source module, the length of each module should be marked along the guide line until the power source module position has been marked. Now, using the one screw supplied, the power source module 110, should be mounted to the wall with its upper rear edge exactly on the guide line. If the wall is plaster, it would be best to pencil mark the hole, and drill the wall for installation of plastic screw anchors, which are also provided with the modules. The illumination module 53, which will be installed to the right of the power source module should then be plugged firmly into the power bus receptacle on the right side of the power source module, the top rear surface of the module aligned with the guide line, and the module mounted to the wall using the two screws supplied. The remaining illumination modules should be installed in the same way on both sides of the power source module. Next a receptacle cap 50 shown in FIG. 4, should be installed in the unused power bus receptacle, at each end of the installation, using the screw 46 supplied. Now the optional power switch 152 shown in FIG. 13, should be installed on line cord, if desired, and the wire anchor 154, installed on the line cord at the same height as the power outlet. Either the screws or adhesive pads supplied may be used to attach the switch and wire anchor to the wall. The line cord should be straightened and stretched tautly against the wall by the wire anchor as seen in FIG. 13. Finally the lamps should be inserted into the modules and then the line cord plugged into the power outlet.

If the installation includes a corner, the installer should start with a corner module, 118 shown in FIG. 8, nearest the power source, and hold that module against the corner with the top of its rear edge aligned with the mark on the wall. The 2 screws provided should be driven into the wall through the mounting holes in that rear surface. Now, a gender conversion plug 42 should be installed in the power bus receptacle 44L or 44R, whichever faces the power source outlet. Working from the corner, towards the power source module, the next module should be plugged tightly onto the one already mounted, and held level with the guide line while the two screws are installed. The gender conversion plug 42, can be installed on the appropriate side either before or after the module is mounted on the wall. Adjacent modules are installed in the same manner up to the power source module and then should proceed from it to the next corner. An adjustable module may be required to accommodate a space shorter than one of the illumination modules.

This modular system includes both inside and outside corner modules. The installation technique for the outside corner module 124 shown in FIG. 9, is the same.

Two adjustable length modules are included in this system, to allow the user to accommodate any length wall by bridging a remaining distance that is shorter than a standard (20, 30 or 40 watt) illumination modules. They are the adjustable straight module 128 shown in FIG. 11, and the adjustable inside corner module 148 shown in FIG. 12. Both of these adjustable length modules incorporate special adjustable endplate assemblies 130L and 130R which do not contain a tube socket and are designed to mount firmly against the end of the module body 150 (See FIG. 12) without the ribs 56, 58 and 60, or the reflector partition 54 having to be notched or recessed. First the installer measures how much length is available for each leg (of the corner module). They should subtract the thickness of the thin sheet 134, of the adjustable endplate assembly 130L or 130R, and mark the remaining distance on the back of the module, measured from the corner to each end. They should remove both adjustable endplate assemblies from the module, and unplug and remove the power bus lead 144 and the ground bus lead 146 from the module. They should then use the metal sleeve 196 supplied to cut both legs of the module body to the lengths marked. This metal sleeve is a 2.5 centimeter (1 inch) length of an aluminum extrusion that encases the outer surfaces of the module shell but is sized to slide easily. The edges of this sleeve are cut normal (square) to its length. The installer than slides this sleeve along the module shell until its edge coincides with the mark where the shell it to be cut, and uses a tab of tape to hold it in place. Holding the razor blade 198 against the sleeve edge, the installer then cuts the module shell squarely and neatly to the desired length. The bus leads are then re-installed in the lower passage, plugged into the contacts on each endplate assembly and the endplate assemblies are inserted firmly into the module body and fastened with the screws supplied. The same technique is used to cut the adjustable straight module to the desired length as shown in FIG. 20.

Corner modules and adjustable modules are designed to provide both electrical and decorative continuity through corners and across lengths which are too short to accommodate a 20 watt illumination module. Should the user also want illumination continuity across these modules the optional light kit can be used. This light kit, illustrated in FIG. 19A, can be easily installed in each end of these modules with just a few simple steps. First, the two screws must be removed from the inside flange of module ends 112L or 112R or the end assembly 130L or 130R, to permit these end pieces to be removed and the power bus and ground bus leads to be unplugged from them. Next, the installer must cut a small notch 192 in the reflector partition 54 as shown in FIG. 19B. Then the installer must plug those leads into the receptacles 190 and 188 on the starter-ballast enclosure 186, and slide the choke 92 and enclosure into the lower passage of the module shell. They must then place the socket 180 on the reflector partition 54 with the wire in the notch 192, and positioned to clear the mounting flanges of the module end pieces. Two screws 46 are used to secure the socket to the partition and the lamp 178 is then plugged into the socket. Finally, the power bus lead 182 and the ground bus lead 184 from the ballast enclosure are plugged into the receptacles of the module end piece, which is then replaced on the module and secured with the two screws that were first removed. The optional illumination kits can also be installed in corner modules as is illustrated in FIG. 21 using essentially the same steps described above for the adjustable length modules. It is also possible that corner modules could be offered by the manufacturer in both the non-illuminated and illuminated configurations.

While this modular lighting system is assembled by the user from a number of modules, the installation can be given a "seamless" appearance by use of the front channel 62, built into each module body, which will accept a decorative facing strip 126, that runs the length of the entire installation, spanning the seams between all the modules. This decorative strip can simply be a strip of paper, painted to match or harmonize with the wall color. A series of decorative strips will be made available to the user which will include embossed patterns, wood grain, metallized plastic, cloth and other flexible materials. The user need only cut the decorative strip to the proper length, miter the corners (using the template supplied—that will establish the proper miter angle) and snap the strip into the facing channel, as illustrated in FIG. 10.

A luxury assortment of three-dimensional facings can also be made available, that duplicate the curvatures of classic cove moldings. This decorative cove molding 172 (See FIG. 17), can be extruded lengths of flexible plastic manufactured in 4 to 7 meter sections, that can be joined together or cut to length and then properly mitered (using the template supplied) and then snapped into the facing channel to provide the finished appearance of a classic custom illuminated cove. These luxury facings can be painted before or after installation. Joint covers may also be supplied that may be used in very long rooms to conceal the joint between two lengths of decorative cove molding facings. These covers could be made available both as simple fairings that span the seam and in the form of elaborate three-dimensional crests and other baroque styles.

SUMMARY, RAMIFICATION, AND SCOPE

Accordingly, the reader will see that the modular, user-installed, surface mounted, fluorescent lighting system of this invention can be easily, safely and quickly installed by an inexperienced user, and will provide an attractive, economical, and nearly continuous source of illumination. The standard modules that comprise this system, which are the power source, illumination, inside corner, outside corner, and vertical offset modules, are all designed to be used as manufactured, without any user modifications. They do not require the services of a licensed or experienced electrician and may be installed by anyone who can follow very simple, illustrated instructions. The only tools required are a tape measure and a screwdriver. Furthermore this modular lighting system has the additional advantages in that:

- it can be installed in any room, providing electrical continuity around inside and outside corners, over nearly any length, limited only by the electrical capacity of the power outlet into which it is plugged;
- it incorporates electrical safety features which permit the user to configure each module into the safe arrangement of male and female connectors through the installation of a gender conversion plug with just a single screw;
- installation of adjustable length modules, to achieve a precise fit between room corners, is easily accomplished using a simple metal sleeve and blade (both supplied with the module) to cut the module body extrusion to the proper length, neatly;
- while it is assembled from small inexpensive modules it incorporates design features to conceal the module seams and easily create a very decorative, continuous appearance;
- it utilizes a decorative facing strip that can easily and inexpensively be replaced to accommodate any subsequent redecoration of the room.

Although the description above contains many specificities, these should not be construed as limiting the scope of the invention but as merely providing illustrations of some of the presently preferred embodiments of this invention. For example, the module shell extrusion (used in all modules) could also have a bottom channel built into it, similar to the front channel, that would permit a continuous decorative strip to be used across the bottom of the installation as well. Also, the modules could be produced with male connectors at both ends, and a female-to-female gender converter could be used to configure their gender for a safe installation. And, the functions and components of the power source module and the illumination module could be combined into a single entity. In another ramification the line cord, providing power to the power source module, could be replaced with the blades of a male power plug, protruding from the rear of the power source module. This configuration would be used in installations where the installer, or builder, has provided a power source wall outlet at the proper height, to accommodate this system and provide the appearance of a custom installation. Yet another ramification could involve the use of a vertical shield snapped into the front channel to shield the tube from direct view if the modules are mounted below eye-level, inverted—to provide area lighting, or mounted on the ceiling to illuminate a wall, a picture, or drapes, etc.

Thus the scope of the invention should be determined by the appended claims and their legal equivalents, rather than the examples given.

I claim:

1. A modular, user-installed, surface-mounted, fluorescent lighting system that projects light primarily in a plane parallel to a mounting surface, having in combination:

(a) a plug-in illumination module comprising a starter-ballast circuit, an integral power bus and a pair of power bus receptacles each having a pair of electrical contacts, and (b) a power source module having a plug-in line cord to convey power from a convenience wall outlet to the mounting surface location where said illumination module is mounted, and a resettable circuit breaker to isolate a short circuit in said lighting system, from said convenience wall outlet, wherein said circuit breaker also serves to protect said integral power bus from overload by limiting the quantity of said plug-in illumination modules that may be installed in a serial sequence, and (c) a configuring means which, in combination with said electrical contacts in said power bus receptacles on said power source module and said illumination modules, are used to configure each module with appropriate male and female plug-in electrical couplings to minimize accidental shock by assuring that power is supplied only from female couplings, whereby said configuring means could be easily and quickly installed by a user, by just plugging said configuring means into said power bus receptacles, without any disassembly, and using just a screwdriver to fasten said configuring means to the appropriate power bus receptacle.

2. The fluorescent lighting system of claim 1, further including an extending means for extending the electrical continuity of this installation around inside and outside corners of said mounting surface, in combination with said configuring means, whereby said extending means is of similar cross-sectional shape and appearance to said illumination modules.

3. The fluorescent lighting system of claim 2, further including an adjustable module in combination with a trimming means for sizing said adjustable module which is the last module installed on any surface, to the exact length required, easily, safely and quickly without any technical knowledge, using simple tools supplied with said adjustable module.

4. The fluorescent lighting system of claim 3, further including a vertical offsetting means, cooperating with said power bus receptacles to provide electrical continuity to said illumination modules while permitting an installer to offset said illumination modules vertically wherever required to clear other features of said mounting surface, such as windows and door frames, and for decorative purposes, said vertical offsetting means comprising a narrow vertical housing including (i) said power bus, (ii) said power bus receptacles, and said configuring means wherein a vertical serial plurality of said vertical offsetting means and said configuring means are interposed between a pair of said illumination modules.

5. The fluorescent lighting system of claim 4, wherein said starter-ballast circuit is of the electronic-capacitive type, thereby providing increased power efficiency while using components of reduced size and weight and permitting a more compact housing for said plug-in illumination module.

6. The fluorescent lighting system of claim 5, further including decorating means, used in conjunction with a front channel on a front surface of each module, for decorating said front surface of all modules with a color and pattern selected by said user, that also conceals a seam between modules and provides the appearance of a custom installed continuous cove lighting system.

7. The fluorescent lighting system of claim 5, further including an enclosing means, in cooperation with said front channel, to encase the assembled, installed lighting system in a hollow trough-like structure that, may be cut to size by said installer and, will provide the appearance of a custom installation of an illuminated classic architectural cove.

8. A modular, user-installed, surface-mounted, fluorescent lighting system, that minimizes the possibility of accidental shock by permitting an installer to easily configure the system such that powered electrical connectors have only female contacts, comprising:

(a) a power source module comprising a power bus receptacle having a pair of female electrical contacts in a shallow rectangular recess, a resettable circuit breaker, a length of flexible electrical power conductors, and an electrical power plug, with said power bus receptacle being electrically connected through said circuit breaker to one end of the power conductors and said electrical power plug being connected to the other end, wherein said circuit breaker serves to isolate a short circuit in said lighting system, and (b) an illumination module comprising a structure having an integral power bus that can transmit power between two said power bus receptacles mounted at opposite ends of said illumination module, a starter-ballast circuit connected to said integral power bus, and a fluorescent tube socket connected to said starter-ballast circuit, wherein said integral power bus is protected from overload by said circuit breaker in said power source module, by limiting the quantity of said illumination modules that may be installed in a serial sequence, and (c) a gender conversion plug comprising: (i) an insulating body which is slightly smaller than, and twice the depth of, said shallow rectangular recess in said power bus receptacle, (ii) a pair of double-ended male contacts suspended in said insulating body, such that said gender conversion plug can be inserted into said power bus receptacle on said illumination module and convert it to a male connector, which can then be coupled with a device selected from a group consisting of said power bus receptacle on said power source module and said power bus receptacle on another said illumination module, wherein said power bus receptacles of all modules are identical.

9. The fluorescent lighting system of claim 8 wherein said power source module has two said power bus receptacles, positioned back-to-back and joined electrically in parallel, such that it may receive the converted male connectors of said illumination modules on both sides.

10. The fluorescent lighting system of claim 9 wherein said structure of said illumination module is a module shell, which is an extruded elongated trough comprising:

(a) a first wall extending vertically for mounting to a mounting surface, (b) a second wall extending horizontally from lower extremity of said first wall, (c) a third wall extending outwardly and upwardly from the free end of said second wall, (d) a fourth concave wall extending horizontally from just above center of said first wall to the approximate center of said third wall, (e) a lower passage formed by the four walls, which is sized to accommodate said starter-ballast circuit and said integral power bus, (f) an upper passage formed by the intersection of said first wall, said fourth concave wall and said third wall, that is sized to accommodate a fluorescent tube installed in said fluorescent tube socket such that light rays emanating from said fluorescent tube are reflected from the walls of said upper passage.

11. The fluorescent lighting system of claim 10, further including:

(a) an inside corner module that provides electrical continuity, comprising: (i) a shell of identical cross-section to that of said module shell, mitered and joined to form an inside corner shell, (ii) said power bus receptacle mounted at one end of said inside corner shell, (iii) said integral power bus routed through said lower passage of said inside corner shell, and (iv) another said power bus receptacle mounted at opposite end of said inside corner shell, (b) an outside corner module that provides electrical continuity, comprising: (i) said shell of identical cross-section to that of said module shell, mitered and joined to form an outside corner shell, (ii) said power bus receptacle mounted at one end of said outside corner shell, (iii) said integral power bus routed through said lower passage of said outside corner shell, and (iv) said power bus receptacle mounted at opposite end of said outside corner shell, (c) an adjustable straight module that provides electrical continuity, comprising: (i) a length of said module shell, (ii) an adjustable left end plate assembly having said power bus receptacle, (iii) said integral power bus routed through said lower passage of said module shell, (iv) an adjustable right end plate assembly, having said power bus receptacle, installed in opposite end after said module shell has been cut by said installer to the precise length required for a custom installation using a metal sleeve and a razor blade, supplied with said adjustable straight module, to achieve a neat square cut, (d) an adjustable inside corner module that provides electrical continuity, comprising: (i) said inside corner shell, (ii) said adjustable left end plate assembly, (iii) said said integral power bus routed through said lower passage of said inside corner shell, (iv) said adjustable right end plate assembly, wherein both end plate assemblies are installed in respective ends of said inside corner shell after at least one end has been cut by said installer to the precise length required for a custom installation using said metal sleeve and said razor blade, supplied with said adjustable corner module, to achieve a neat square cut, (e) a vertical offset module that provides electrical continuity, comprising: (i) a narrow rectangular vertical housing which can be mounted normal to said mounting surface, (ii) said power bus receptacles mounted at the forward end of both the top and bottom surfaces of said rectangular vertical housing, (iii) said gender conversion plug, used to convert one of said power bus receptacles on said vertical offset module into a male configuration that can be electrically coupled with said power bus receptacle on another said vertical offset module, mounted vertically adjacent, (iii) said power bus receptacles mounted at the lower rear end of each side wall of said rectangular vertical housing such that they could be coupled with said power bus receptacles on said illumination modules, that might be coupled to each side of said vertical offset module, and (iv) internal electrical conductors that join all said power bus receptacles, within said vertical offset module, in a parallel circuit.

12. The fluorescent lighting system of claim 11, further including a front channel, extending horizontally, which covers the front face of each module shell, and can be used to attach a decorative surface selected from a group consisting of:

(a) a decorative facing strip that may be inserted into said front channel such that said decorative facing strip spans all seams between modules and provides the appearance of a continuous illumination cove, and (b) a cove molding which is an extruded elongated trough having an exterior shape that simulates an architectural cove, and is large enough to encase the front and bottom surfaces of said module shell, having a pair of longitudinal flanges along its inner surface that may engage a pair of retaining lips of said front channel, and which will conceal all modules of said illumination system within what appears to be a custom installation of an illuminated architectural cove.

13. The fluorescent lighting system of claim 12, further including an illumination means which in combination with said integral power bus will provide lighting for all corner modules and adjustable modules, comprising a conventional U-tube fluorescent lamp, wherein its existing socket has been adapted to mount in said upper passages of all corner modules and all adjustable modules, and its existing starter-ballast assembly has been adapted to mount in said lower passage of these modules, and this new socket is connected to this redesigned starter-ballast assembly through a small notch made in said fourth concave wall of said module shell, and this redesigned starter-ballast assembly is connected to said integral power bus.

14. The fluorescent lighting system of claim 13, wherein said starter-ballast circuit is an electronic-capacitive type, thereby providing increased power efficiency while using components of reduced size and weight and permitting a more compact housing for said illumination module.

15. A modular, user-installed, surface-mounted, fluorescent lighting system having in combination the following known elements:

(a) a wall mounted cove fixture for indirect lighting using fluorescent lamps, and (b) a fluorescent illumination module which is surface-mounted and self-contained including a tube socket, a starter-ballast circuit and an integral power bus, and (c) junction fittings to accommodate turns, of 90 degrees in two planes, and (d) a decorative insert of continuous length installed on a structure that houses wall-mounted fluorescent lighting fixtures, and (e) an electronic capacitive ballast for fluorescent lamps, wherein the improvement comprises:

(i) a pair of power bus receptacles, each containing a pair of female electrical contacts, installed in said illumination module and a means, cooperating with said power bus receptacles, to configure the electrical couplings of each module to male and female contacts, such that power is supplied from only female contacts, thereby decreasing the possibility of accidental shock, and (ii) a power source connection means, in cooperation with said power bus receptacles, on all modules, to connect said lighting system to a convenience wall outlet, using a power source module, comprising a resettable circuit breaker and a plug-in line cord, thereby avoiding the requirement for an experienced installer, whereby said circuit breaker serves to isolate a short circuit in said lighting system and to protect said integral power bus from overload by limiting the quantity of said illumination modules that can be installed in a serial sequence, and (iii) a sizing means, in combination with an adjustable module to adjust the length of said adjustable module, installed in a linear plurality of said illumination modules, to achieve a perfect fit between two corners of a room, whereby this adjustment can be accomplished by an inexperienced installer, without any tools other than a metal guide sleeve and a razor blade, supplied with the module, and (iv) an illumination means, cooperating with said integral power bus, to illuminate those modules of said lighting system that provide the electrical continuity through corner turns and segments of adjustable length, and (v) an enclosure means, in cooperation with said front channel, to completely encase the structure of said illumination system in a decorative architectural cove molding and provide the luxurious appearance of a custom installation of an illuminated cove.

* * * * *